US006747423B2

(12) United States Patent
Ludorf

(10) Patent No.: US 6,747,423 B2
(45) Date of Patent: Jun. 8, 2004

(54) CIRCUIT CONFIGURATION TO OPERATE A GAS DISCHARGE LAMP

(75) Inventor: Werner Ludorf, Bergen (DE)

(73) Assignee: TridonicAtco GmbH & Co. KG, Dornbirn (AT)

( * ) Notice: Subject to any disclaimer, the term of this patent is extended or adjusted under 35 U.S.C. 154(b) by 175 days.

(21) Appl. No.: 10/179,176

(22) Filed: Jun. 26, 2002

(65) Prior Publication Data

US 2003/0025466 A1 Feb. 6, 2003

Related U.S. Application Data

(63) Continuation of application No. PCT/EP00/10557, filed on Oct. 26, 2000.

(30) Foreign Application Priority Data

Dec. 27, 1999 (DE) ..... 199 63 289

(51) Int. Cl.[7] ..... H05B 37/02
(52) U.S. Cl. ..... 315/307; 315/291; 315/225
(58) Field of Search ..... 315/119, 224, 315/225, 209 R, 291, 307, DIG. 5, 243

(56) References Cited

U.S. PATENT DOCUMENTS 4,734,624 A 3/1988 Nagase et al. ..... 315/243
5,365,151 A 11/1994 Spiegel et al. ..... 315/209
6,198,231 B1 * 3/2001 Schemmel et al. ..... 315/225
6,426,597 B2 * 7/2002 Rast et al. ..... 315/219
6,437,515 B1 * 8/2002 Kamoi et al. ..... 315/209 R

FOREIGN PATENT DOCUMENTS

JP 10 022083 A 4/1998
WO WO 8604752 A 8/1986

* cited by examiner

*Primary Examiner*—Don Wong
*Assistant Examiner*—Jimmy T. Vu
(74) *Attorney, Agent, or Firm*—Fitzpatrick, Cella, Harper & Scinto

(57) ABSTRACT

In a circuit configuration to operate a gas discharge lamp (LA) the lamp (LA) is arranged in a full bridge circuit. A control circuit in normal operation actuates the four switches (S1–S4) in such a way that it changes over with a first frequency (f1) alternately between a first and a second state ($T_1$, $T_2$), whereby in the first state (T1) the two switches (S2, S3) of a first bridge diagonal are opened, one switch (S1) of the second bridge diagonal is closed and the other switch (S4) with a second frequency (f2), which is higher than the first frequency (f1), is alternately opened and closed. In the second state ($T_2$) the four switches (S1–S4) are actuated in such a way that the lamp (LA) is pole reversed. In a start phase ($T_S$) on the contrary the switch connected to the DC voltage source (S4) of a half-bridge is opened, the second switch (S3) of this half-bridge is closed, and the two switches (S1, S2) of the other half-bridge are with a third frequency (f3) alternately opened and closed. As a result reliable lamp starting is rendered possible and at the same time the generation of high-frequent alternating fields in normal operation is reduced.

13 Claims, 2 Drawing Sheets

CIRCUIT CONFIGURATION TO OPERATE A GAS DISCHARGE LAMP

CROSS REFERENCE TO RELATED APPLICATIONS

This is a continuation of International application PCT/EP00/10557 filed Oct. 26, 2000 and which was published as WO 01/49082 A1 on Jul. 5, 2001 in the German language, but not in English, and the priority of which is claimed under 35 U.S.C. §120, which International Application in turn claims the priority of German application No. 199 63 289.8 filed Dec. 27, 1999.

BACKGROUND OF THE INVENTION

1. Field of the Invention

This invention relates to a circuit configuration to operate a gas discharge lamp, in particular a low pressure-discharge lamp, and to a method of operating a gas discharge lamp.

2. Description of the Related Art

In the design of electronic chokes to operate gas discharge lamps essentially two requirements have to be met. On the one hand the electronic choke is intended to facilitate reliable and effective lamp operation, on the other hand the choke and the lamp should not interfere with the function of other apparatus or have any effects on the surroundings.

In order to achieve as high as possible lamp efficiency, gas discharge lamps are normally operated at high frequencies in a range of 20 to 50 kHz. At these frequencies the electron density in the plasma of the fluorescent lamp is no longer able to follow the time variation of the current, so that an essentially time-constant, average electron density ensues. In this case in the event of a crossover of the mains supply no further current gap arises to reignite the lamp, so that compared to lamp operation at a normal mains frequency, e.g. 50 Hz, with a constant stream of light a reduction in electrical consumption of 8 to 10% can be achieved.

On the other hand as a result of the high frequency operation of the lamp high-frequency alternating fields arise, in which an adverse effect on the surroundings cannot be totally ruled out. For example these alternating fields may lead to complaints from people in the vicinity, for example of headaches or similar conditions. In particular, regarding gas discharge lamps which are shaped in the form of long tubes, steps must be taken to limit their radiated field strength.

The easiest way to prevent high-frequency fields arising is to again reduce the operating frequency of the lamp and to operate ideally with DC current. However in practice it is not possible to operate the lamps using pure DC voltage, since gas discharge lamps have a negative characteristic. This can—from an economic point of view—only be reasonably counteracted by using a choke. Operating with pure DC voltage in addition has the disadvantage that the electrodes of the lamp wear out unevenly, which can be seen in irregular discoloration or blackening of the glass around the electrodes.

A circuit configuration, which on the one hand allows high-frequent lamp operation and on the other hand produces high-frequent alternating fields to a relatively limited extent, is described in WO 86/04752. In this case the lamp is arranged in a full bridge circuit comprising four controllable switches and actuated in such a way that in a first operating phase two switches lying diagonally opposite each other are opened, while one of the two switches of the second bridge diagonal is permanently closed and the other is pulsed at high frequency. During this time current flows through the lamp essentially in one direction. In order to prevent harmful deposits occurring over a period of time on the electrodes, the four switches are actuated in a second operating phase after a certain period so that the two previously permanently opened switches are closed or pulsed at high frequency, while the other two switches are opened, which effectively corresponds to pole reversal of the lamp. In this way the lamp is operated with a low-frequency voltage signal, which is superimposed with high-frequency oscillation. Since however the amplitude of the high-frequency oscillation is relatively low, high-frequency alternating fields are produced and diffused into the atmosphere only to a relatively minimal extent.

SUMMARY OF THE INVENTION

It is the aim of the present invention to provide a full bridge circuit configuration to operate a gas discharge lamp—preferably a low pressure-discharge lamp, through which the lamp is operated with a high degree of efficiency and which, on the other hand, facilitates efficient lamp starting. At the same time the diffusion of high frequency fields should be reduced.

This aim is achieved by a circuit configuration which has first, second, third and fourth controllable switches. The first and second switches are arranged in series with each other between DC voltage supply terminals, and the second and fourth switches are also arranged in series with each other between the DC voltage supply terminals. A first nodal point between the first and second switches and a second nodal point between the third and fourth switches are connectable, respectively, to opposite terminals of a gas discharge lamp. A control circuit is connected to open and close the switches according to a first state, a second state and a start state. The first state and second states occur alternately to each other at first frequency. Also, in the first state, the second and third switches remain open and the first switch remains closed while the fourth switch opens and closes at a second frequency which is higher than the first frequency. In the second state, the first and fourth switches remain open and the third switch remains closed while the second switch opens and closes at the second frequency. In the start state, the fourth switch remains closed, the third switch remains open and the first and second switches open and close alternately at a third frequency.

With this circuit, the lamp is operated with a full bridge circuit in such a way that switching over takes place between two bridge diagonals in normal operation with a first frequency, whereby each time the switches of the one bridge diagonal are opened and the switches of the other bridge diagonal are closed or are pulsed with a second frequency, which is greater than the first frequency. Here also the gas discharge lamp is therefore operated in normal operation with a voltage signal which is composed of a first low-frequent signal with a relatively high amplitude as well as a second high-frequent signal with a low amplitude. According to the invention, however, to start the lamp the switch of a half-bridge connected to the DC voltage source of the full bridge circuit is opened, while the second switch of this half-bridge is closed and at the same time the two switches of the other half-bridge are high frequent opened and closed. Therefore the lamp is supplied for starting with an AC voltage the amplitude of which is greater than the amplitude of the low-frequent voltage signals in normal operation and the frequency of which is less or equal to the second high frequency. Therefore the lamp when starting is operated for a short time with a strong high frequent signal, while it is supplied after ignition with a DC voltage changed over to low frequency, which is only superimposed by the high frequency. In this way considerably better and smoother lamp starting is achieved. Also at the same time however very low values of radiation possibly arising are assured which does not lead to any ill-health effects on people in the vicinity, since the high frequency-signal overlays the lamp DC current to a correspondingly minimum extent. In addition through the periodic switch-over of the lamp current to low-frequency, for example in the mHz to Hz range, it is guaranteed that the electrodes wear out equally and no irregular discoloration or blackening of the lamps will occur at one end.

Further developments of the invention are described and claimed herein. Since a circuit configuration according to the invention ensures reliable lamp operation and at the same time diffusion of high frequent alternating fields is considerably reduced, very high frequencies can be used for the switches pulsed in normal operation. In particular it is conceivable to pulse the switches at a frequency of above 1 MHz—preferably even in the range between 2.2 MHz and 3.0 MHz. This is roughly 20 to 100 times higher than the present normal operating frequencies of between 20 kHz and 50 kHz. In this way the possibility of increasing lamp efficiency is created. The frequency range between 2.2 MHz and 3.0 MHz in this case is especially favorable, since standards of most jurisdictions allow in this frequency range, a somewhat increased diffusion of interference on the mains supply in the form of upper waves.

Also, surprisingly it has been shown that low pressure-discharge lamps possess extremely good striking characteristics at these maximum frequencies. In this case the pulse sequence according to the invention is also particularly suitable for starting lamps in the megahertz-range. Due to the good striking characteristics even pre-warming of the lamp-electrodes can possibly be dispensed with and the lamp instead can be started immediately from cold. This again means that a relatively simple circuit configuration can be used.

If in fact lamp operation in the megahertz-range is selected, another advantage is that the capacitance and inductance values of some of the component parts used in the circuit configuration can be reduced in such a way that instead of using discrete structural elements these can be fully integrated. In particular passive structural elements such as chokes and capacitors, which for example can be component parts of a serial resonance circuit arranged in the bridge arm, or transformers are a good case for integration so that a considerable reduction in the dimensions of the overall circuit can be achieved. The structural elements can for example be integrated as part of a multi-layer printed circuit board. Preferably the multi-layer circuit is produced in the form of a LTCC (Low Temperature Cofired Ceramic) structure which consists of several low sintering ceramic layers or films placed on top of each other, between which circuit tracks, capacitor-forming dielectric layers or similar are located.

According to a further aspect of the invention, there is provided a novel method of operating a gas discharge lamp. This novel method involves supplying the gas discharge lamp in normal operation with an AC voltage, which comprises a first signal having a first frequency and a first amplitude, onto which a second signal having a second frequency and a second amplitude is superimposed. The second frequency is greater than the first frequency and the first amplitude is greater than the second amplitude. The method also involves supplying the gas discharge lamp in a start phase with an AC voltage, the amplitude of which is greater than the first amplitude and the frequency of which is equal to or less than the second frequency.

BRIEF DESCRIPTION OF THE DRAWINGS

A preferred embodiment of the invention is shown and described herein. In the drawings.

DETAILED DESCRIPTION OF THE PREFERRED EMBODIMENT

Figure 1:
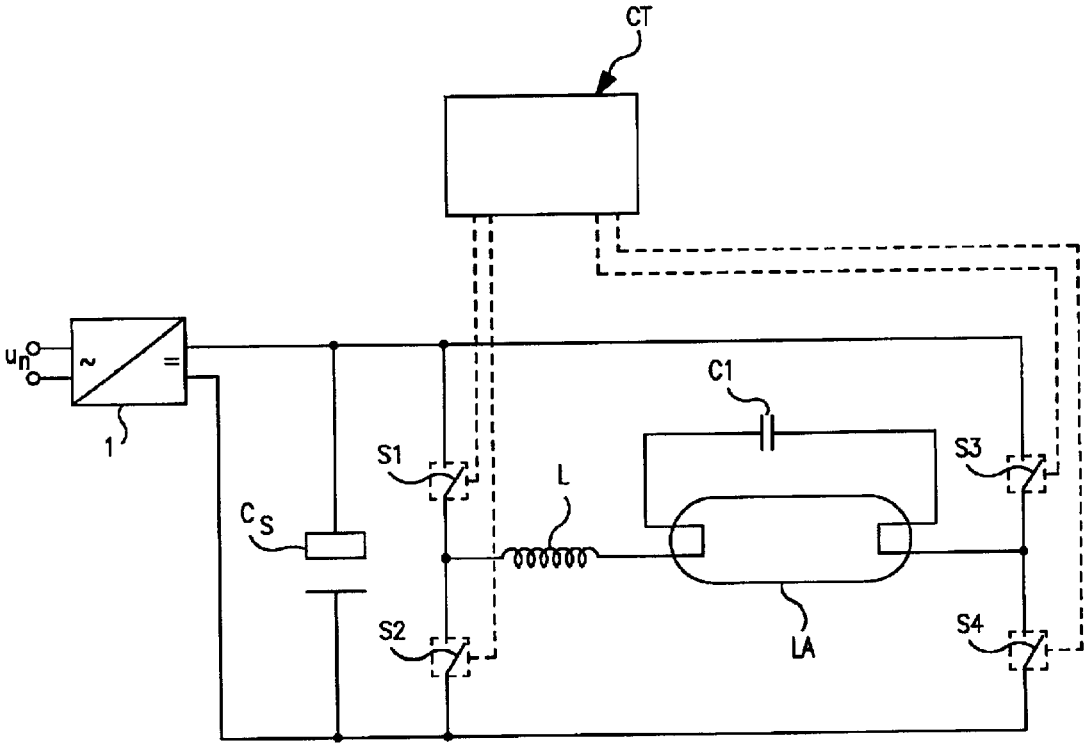
FIG. 1 is a schematic diagram of a circuit which embodies the invention.

In FIG. 1 an input of a choke which forms a rectifier circuit 1, such as a bridge rectifier or the like, is connected to a mains AC voltage $U_n$. An electrolyte capacitor, such as an electrolyte condenser $C_s$ functioning as storage condenser is located between a positive output of the rectifier circuit 1 and the input of the full bridge circuit. The rectifier circuit provides a DC voltage supply between upper and lower terminals $T_1$ and $T_2$.

Also as shown in FIG. 1, a full bridge circuit is provided which comprises first, second, third and fourth controllable switches S1 to S4, which for example are formed by MOS-field effect transistors. The switches S1 and S2 are connected in series with each other between the terminals $T_1$ and $T_2$ and the switches S3 and S4 are connected in series with each other between the terminals $T_1$ and $T_2$. A first nodal point n, between the switches S1 and S2 and a second nodal point $n_2$ between the switches S3 and S4 are connectable to opposite ends of a gas discharge lamp LA, which may be a low pressure discharge lamp, so that the gas discharge lamp is located in an arm of a bridge circuit between center taps of two half-bridges. In addition, a serial resonance circuit consisting of a choke coil L and a resonance condenser C1 is arranged in the bridge arm, whereby the low pressure-discharge lamp LA and the resonance condenser C1 are connected in parallel. The four switches S1 to S4 are connected to and are actuated by a control circuit CT.

The circuit configuration shown in FIG. 1 can in the known way be extended by monitoring circuits, which record lamp operating parameters—for example lamp voltage and lamp current—and independently of these influence the actuation of the switch or the lamp. In this case it would also be possible to record lamp defects or similar. Such circuit extensions are however not the object of the present invention and will therefore not be considered any further.

Figure 2:
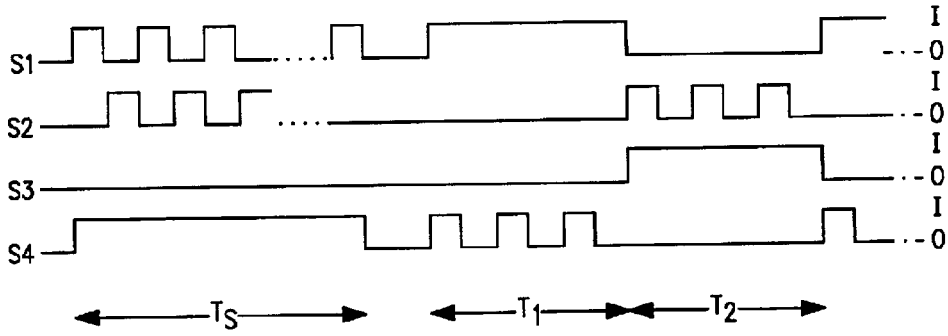
FIG. 2 a timing diagram showing a pulse sequence for actuating the circuit of FIG. 1.
Figure 3:
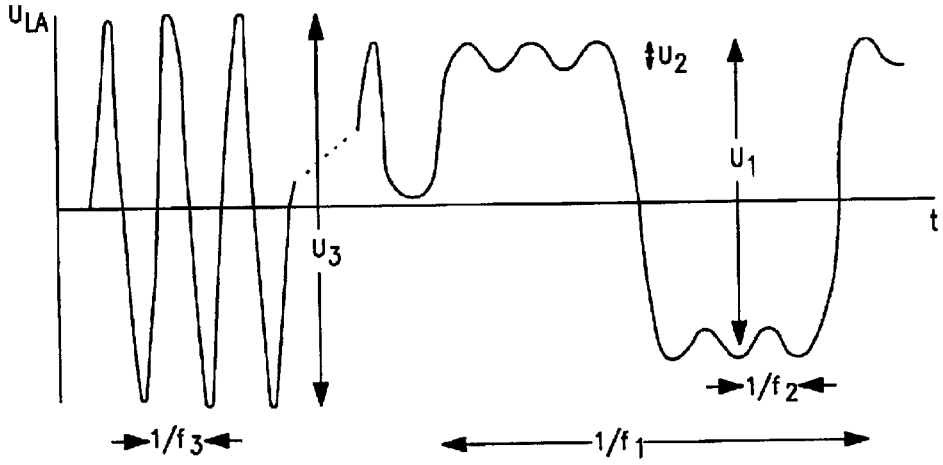
FIG. 3 is a sequence of waveforms which illustrate an idealized time variation of lamp supply voltages produced by the circuit shown in FIG. 1.

The actuation of the four switches S1 to S4 of the full bridge circuit will now be described by way of FIG. 2. According to the invention, during a start phase $T_1$ only the switches of one of the two half-bridges, in the example shown switches S1 and S2 of the left half-bridge, are to be pulsed. To start the lamp LA therefore the switch S3 is opened (0), the switch S4 is closed (1) and the switches S1 and S2 are alternately high frequent opened and closed. The idealized lamp voltage $U_{LA}$ supplying the discharge lamp LA resulting in consequence is shown in FIG. 3. As can be seen from the signal behavior curve, a high-frequency AC voltage with a frequency f3 and a relatively high amplitude $U_3$ results. In this case, the frequency f3 preferably lies above 1 MHz, especially advantageously in the range between 2.2 MHz and 3.0 MHz. Since gas discharge lamps at these frequencies have shown themselves to have extremely good striking characteristics, pre-warming of the electrodes of the lamp LA can possibly be dispensed with. However it can be advantageous if the frequency f3 of the pulse signal for the switches S1 and S2 to start the lamp LA is reduced in the direction of the resonance frequency of the serial resonance circuit.

After the lamp LA has ignited, the four switches S1 to S4 are actuated in normal operation. In this case in a first state $T_1$ the two switches S2 and S3 of the one bridge diagonal are permanently opened, while the switch S1 is permanently closed and the switch S4 is high frequent pulsed. Also the switching frequency f2 for the switch S4 preferably lies between 2.2 MHz and 3.0 MHz, for example at approx. 2.65 MHz, and is equal to or higher than the frequency f3. After a certain time the control circuit changes to a second state $T_2$, in which the two switches S1 and S4 of the previously pulsed bridge diagonal are now opened, while switch S3 is now closed and switch S2 is high frequent pulsed also with the frequency f2. The two states $T_1$ and $T_2$ alternate at a very low frequency f1.

Accordingly, in normal operation the lamp voltage $U_{LA}$ supplying the lamp LA also shown in FIG. 3 results. In this case it should be noted that for reasons of clarity the ratio between the high frequency f1 and the low change over frequency f1 is shown out of scale. The high frequency f2 preferably lies in the megahertz range, while the change over frequency f1 for example can be 50 Hz or even considerably less—down to a few mHz. Overall however a very low-frequency voltage with an amplitude $U_1$, which overlays a high-frequency voltage with a very small amplitude $U_2$, results. $U_1$ in this case is lower than the ignition voltage $U_3$. Since however the high-frequency quotient of the signals must be considered first of all for the environmental compatibility of the lamp-choke system, any negative effect on health can be ruled out. Moreover the start phase $T_S$ is only very short, so that also here the reason for complaints can be excluded.

Due to the high frequency quotient in the control voltages occurring both in the start phase $T_S$ as well as during normal operation $T_1$, and $T_2$, chokes and condensers with relatively low capacitance and inductance values can be used for the serial resonance circuit. In this case it is possible to integrate these component parts in a multi-layer circuit, for example an LTCC multi-layer circuit. Such multi-layer circuits, which consist of several low sintering ceramic layers placed one on top of another are already finding application in wide areas. For the circuit configuration according to the invention however this represents an especially advantageous form of embodiment, since in this case the dimensions of the circuit configuration or the whole choke can be considerably reduced, which again results in the fact that further shielding devices can be fitted to the choke at no great extra effort.

What is claimed is:

1. A circuit for operating a gas discharge lamp from a DC voltage supply, said circuit comprising:

first, second, third and fourth controllable switches, said first and second switches being arranged in series with each other between DC voltage supply terminals, and said second and fourth switches being arranged in series with each other between said DC voltage supply terminals;

a first nodal point between said first and second switches and a second nodal point between said nodal point between said third and fourth switches being connectable to opposite terminals of a gas discharge lamp;

a control circuit connected to open and close said switches according to a first state, a second state and a start state, wherein said first state and said second state occur alternately to each other at first frequency, and wherein in said first state, said second and third switches remain open and said first switch remains closed while said fourth switch opens and closes at a second frequency which is higher than said first frequency, in said second state, said first and fourth switches remain open and said third switch remains closed while said second switch opens and closes at said second frequency, and in said start state, said fourth switch remains closed, said third switch remains open and said first and second switches open and close alternately at a third frequency.

2. A circuit according to claim 1, wherein the second frequency is greater than 1 MHz.

3. A circuit according to claim 2, wherein the second frequency lies in the range between 2.2 MHz and 3.0 MHz.

4. A circuit according to one of claims 1 to 3, wherein the third frequency is greater than 1 MHz.

5. A circuit according to claim 4, wherein the third frequency lies in a range between 2.2 MHz and 3.0 MHz.

6. A circuit according to claim 1, wherein a serial resonance circuit is connected between said first and second nodal points.

7. A circuit according to claim 6, wherein said serial resonance circuit comprises a choke coil (L) and a resonance capacitor, and wherein a gas discharge lamp is connectable in parallel with the resonance capacitor.

8. A circuit according to claim 1, wherein said circuit is formed with passive structural elements which are integrated as a multi-layer circuit.

9. A circuit according to claim 8, wherein said multi-layer circuit comprises an LTCC structure, which includes several low sintering ceramic layers placed one on top of another.

10. A circuit according to claim 1, wherein said DC voltage supply terminals are connected to an electronic choke which includes a rectifier circuit which is connectable to an alternating voltage source.

11. A method of operating a gas discharge lamp comprising the steps of:

supplying said gas discharge lamp in normal operation with an AC voltage, which consists of a first signal having a first frequency and a first amplitude, onto which a second signal having a second frequency and a second amplitude is superimposed, said second frequency being greater than said first frequency and said first amplitude being greater than said second amplitude; and supplying said gas discharge lamp in a start phase with an AC voltage, the amplitude of which is greater than said first amplitude and the frequency of which is equal to or less than said second frequency.

12. A method according to claim 11, wherein said second frequency is greater than 1 MHz.

13. A method according to claim 12, wherein said second frequency lies in a range between 2.2 MHz and 3.0 MHz.

* * * * *